US007631859B2

(12) United States Patent
Milillo et al.

(10) Patent No.: US 7,631,859 B2
(45) Date of Patent: Dec. 15, 2009

(54) DUAL DISC STACKER/STITCHER HIGH SPEED FINISHER

(75) Inventors: William D. Milillo, Ontario, NY (US); Douglas F. Sundquist, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 120 days.

(21) Appl. No.: 11/906,331

(22) Filed: Oct. 1, 2007

(65) Prior Publication Data

US 2009/0085281 A1 Apr. 2, 2009

(51) Int. Cl.

| | |
|---|---|
| ***B65H 29/20*** | (2006.01) |
| ***B65H 39/00*** | (2006.01) |
| ***B65H 29/00*** | (2006.01) |
| ***B65H 29/66*** | (2006.01) |

(52) U.S. Cl. ..... 270/58.07; 270/58.08; 270/58.09; 270/58.11; 270/60; 271/315; 271/187; 271/65; 271/902

(58) Field of Classification Search ..... 270/58.07, 270/58.09, 58.11, 58.12, 60, 19, 13
See application file for complete search history.

(56) References Cited

U.S. PATENT DOCUMENTS

| | | | | |
|---|---|---|---|---|
| 5,188,353 | A * | 2/1993 | Parks | 271/184 |
| 6,443,450 | B1 * | 9/2002 | Antinora | 271/315 |
| 6,575,461 | B1 * | 6/2003 | Rider | 271/315 |
| 2008/0036136 | A1 * | 2/2008 | Dobrindt | 271/178 |

* cited by examiner

*Primary Examiner*—Gene Crawford
*Assistant Examiner*—Yolanda Cumbess
(74) *Attorney, Agent, or Firm*—James J. Ralabate

(57) ABSTRACT

This is a stacker/stitcher assembly having two disc stackers facing each other. In between the stackers is a common collection tray for receiving the stacked substrates. The assembly can handle printed output of up to 360 ppm. A bypass is provided to divert printed substrates to an exit tray or another finishing station including disc stackers.

8 Claims, 3 Drawing Sheets

DUAL DISC STACKER/STITCHER HIGH SPEED FINISHER

This invention relates to finisher stations and, more specifically, to a dual disc stacker assembly for a high speed finisher.

BACKGROUND

While the present invention can be effectively used in a plurality of paper handling or marking systems, it will be described for clarity as used in electrostatic marking systems such as electrophotography. In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area to form a powder image on the photoconductive area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets.

As above noted, there are many marking systems that transport paper or other media after the paper is marked in marking step or steps. These marking systems could include electrostatic marking systems, non-electrostatic marking systems and printers or any other system where paper or other flexible media or receiving sheets are transported internally to an output device such as a finisher and compiler station or stations. These devices include those used for collecting or gathering printed sheets so they may be formed into sets such as books, pamphlets, forms, sales literature, instruction books and manuals and the like.

These electrostatic marking systems have finisher and compilers located at a site after the receiving sheets (paper) have been marked with a toner. A finisher is generally defined as an output device that has various post printer functions or options such as hole punching, corner stapling, edge stapling, sheet and set stacking, letter or tri-folding, Z-folding, Bi-folding, signature booklet making, set binding (including thermal, tape and perfect binding), trimming, post process sheet insertion, saddle stitching and others. In today's marketplace stacking and stitching finishers for cut sheet digital printers or marking systems typically do not exceed throughput rates greater than about 160-180 prints per minute (ppm) for letter size substrates. These rates are typically further reduced when handling small stitched set sizes (i.e. 2-4 sheets). With the emphasis today on digital marking products capable of ever increasing throughput, the need for finishing devices capable of handling these higher speeds for both stacking and stitching for all set sizes is important.

Today, there is no reliable cut sheet digital stacking and stitching finisher module that is capable of handling prints per minute of up to 360 ppm. As throughputs of marking systems become higher and higher, there will be a need for a finisher module capable of handling cut marked sheet substrates for both stacking and stitching at productivity rates of upwards of 200 ppm and greater and at the same time not being large and bulky so as to take up valuable space at the finisher station. Also, a module capable of providing both stapled and non-stapled prints would enhance the versatility and adaptability of such a finisher module.

Disk or disc-stacking apparatus and sheet inverters are well known in the art such as disclosed in Xerox U.S. Pat. Nos. 5,188,353; 5,261,655; 5,409,202; 5,476,256; 5,570,172; 5,842,695; 6,443,450 and 6,575,461. The disclosures of these Xerox Patents are incorporated by reference into this disclosure.

SUMMARY

Embodiments of this invention provide a disc stacker configuration that achieves a specific throughput speed using two sets of disc stackers each effectively running at half speed. The disc sets reside on opposite sides of a common tray that is sized to handle dual stacks of A4/LTR or other suitable size sheets. The tray is large enough to allow sufficient space between the dual stacks to prevent interference during stacking and also enables stacking of A3/11×17 sheets by one disc set without needing to move the second disc away for clearance. In dual stacking (high speed) mode, the user and scheduler ensure job integrity as the output stream is split between two stackers. For face-up or face-down consistency, sheet inversion is required prior to at least one of the disc sets. This is done electronically via the scheduler or mechanically with a sheet inverter. Sheet inverters are well known in the art and defined in the above-listed patents. In high speed stacks mode, sheets are alternately delivered to each disc set. In high speed stitch mode, paired sheets can be alternately delivered to each disc set to provide more time to complete the final rotate-stitch-eject action; however, a skipped pitch may be necessary in odd set size jobs depending on throughput speed. In stitched output paired sheet stacking is required to achieve 2 sheet stitched sets at full productivity. Embodiments of this invention provide higher stacking speeds using prior art lower speed stacking technology. The present invention will achieve intended output rates without significant new hardware but may require some scheduler changes.

Therefore, using existing disc stacker technology in a part of this invention, the embodiments of the present invention provide a device capable of handling substrates for both stacking and stapling at faster productivity rates of up to 360 ppm. While the device of the present invention utilizes two-disc stackers facing each other, they share the same stacking tray and would occupy a space not much larger than those of a typical single disc stacker module. The compiling and stacking of both stitched and unstitched output (both offset and non-offset) is performed on one common tray.

DETAILED DESCRIPTION OF DRAWINGS AND PREFERRED EMBODIMENTS

Figure 1:
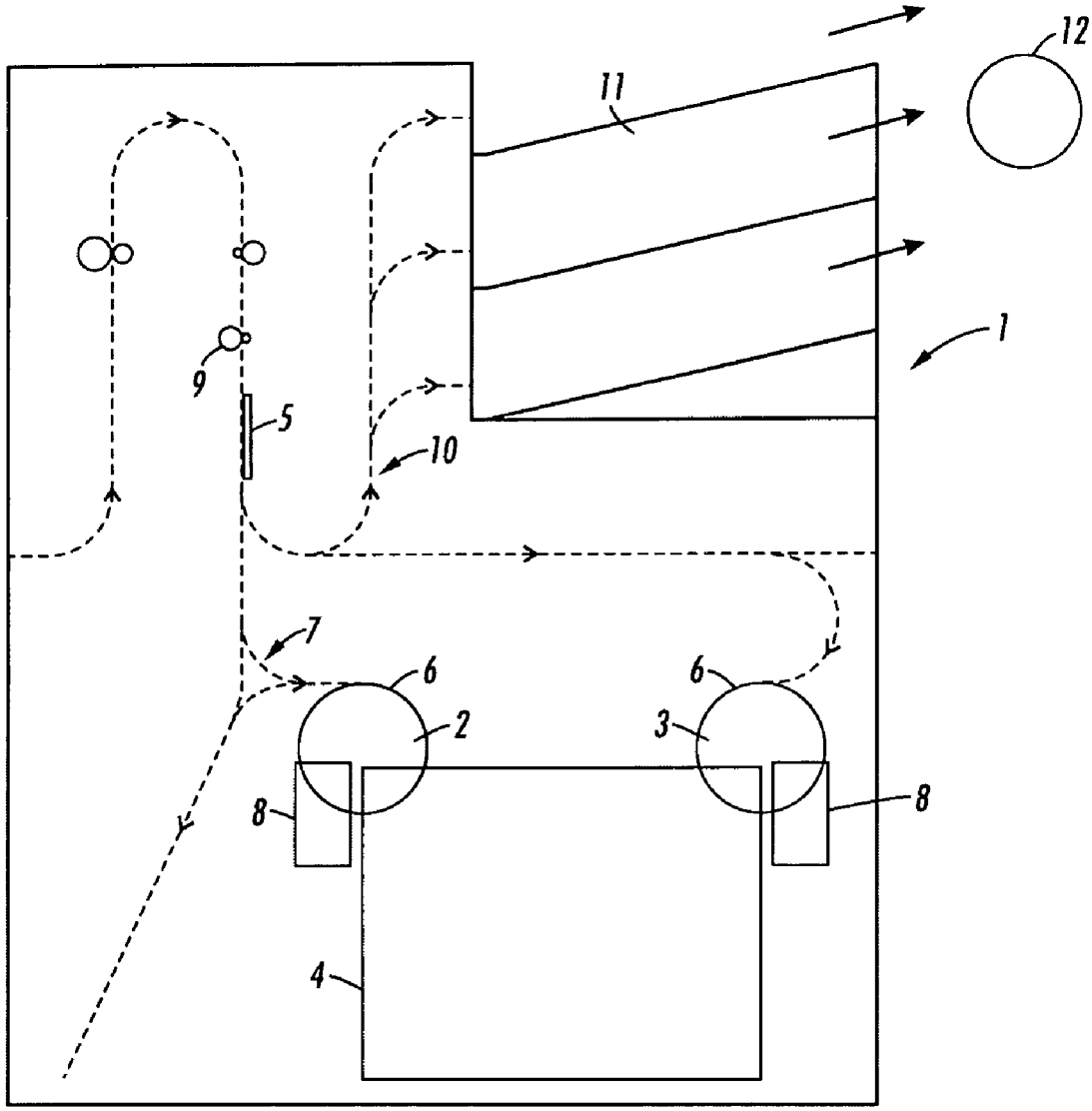
FIG. 1 is a schematic drawing of an embodiment of the dual disc stacker/stitcher of this invention.

In FIG. 1, a schematic is presented showing an embodiment of this invention, a stacking and stitching finishing module 1 capable of handling cut sheet substrates at productivity rates of up to 360 ppm. FIG. 1 illustrates this schematic defining the general concept of an embodiment. The module 1 includes two disc stacking mechanisms 2 and 3 sharing a common compiler/stacker tray 4. The disc stackers 2 and 3 face each other in an opposing arrangement. As marked substrates 5 are driven into the finisher module 1 they are directed in alternating two sheet sequence for stitched output to each of the two disc stackers 2 and 3. In other words, the first and second sheets are directed to the first disc stacker 2 and the third and fourth sheets are directed to the second disc stacker 3. This sequence is continuously followed throughout the process. For unstitched output, the sheets would be directed one at a time alternately and sequentially to each of the two disc stackers. The two sheet sequence is required for stitched output in order to allow additional time for the "stitching" function.

For stitched output, each disc 2 or 3 does not rotate and stack the sheets until two sheets 5 are delivered into the disc input slot 6. The current maximum stacking rate of a prior art Xerox and other disc style stacker is 180 ppm. (Xerox DocuPrint Stacker) By operating two opposing disc stackers 2 and 3 with alternating output to the compiler tray 4, it would be possible to stack and stitch at up to 360 ppm without increasing the current angular velocity of an existing Xerox style stacker. The compiling tray 4 would be large enough to stack letter sized output from both sides of the tray 4 without interfering with the opposing stack. When feeding larger substrates 5, (i.e. 11×17/A3), only one stacker would be utilized since the ppm rates for A3/11×17 typically are one half those of letter sized. This also prevents the need for a larger compiler tray 4 to prevent interaction with the opposing stack. The compiler tray 4 would be approximately the same size as one supporting only one disc stacker.

The ability in stitched output of placing two sheets 5 into the disc stacker input slot 6 and simultaneously rotating and stacking the two sheets 5 at a time has been demonstrated. By stacking two at a time, stitched sets including two sheet sets can achieve full productivity.

In order to avoid skipping pitches when the disc 2 or 3 rotates, sheets 5 would be delivered to the second stacker while the opposite stacker is rotating. This would require some scheduling changes to ensure set integrity since two stitched sets would be compiling at the same time. However, such scheduling algorithms exist today for finishing devices that have temporary compiling stations capable of collecting sheets for multiple sets simultaneously. In a sense, the 2 disc stackers also act as the temporary compiling stations. Also, to maintain face up or face down consistency between the two stackers, an inverter 7 would be needed prior to at least one of the disc stackers 2 or 3. Inverters are well known in the art such as the inverters disclosed in the above-listed patents. An inverter for turning a sheet over and reversing the lead and trail edges of the sheet in one embodiment includes a disc stacker that works in conjunction with a reversing roll inverter. Prior to entering the disc slot, the sheet would be diverted to an alternate paper path and then reverse direction effectively leading with its trail edge thereby flipping the sheet over as it enters the disc.

Another advantage of this invention is that approximately twice the capacity of letter sized sheets can be handled in the same compiler tray 4 space as single disc stackers only 3 making the overall footprint not much larger than that of a single disc stacker architecture. A stapler 8 in one embodiment is provided with each disc stacker.

Embodiments of this invention also provide a modularity feature whereby several options including the stitching function can be added or removed from the base module in order to customize the finisher to a particular customer need. The various options include a decurler 9, active registration system and sheet rotator 7. The finisher 1 in one embodiment also includes a separate bypass paper path to direct output to additional downstream finishing modules 10 or to an auxiliary disc stacker or to a tray for removal from the system.

The disc stackers 2 and 3 are connected to a machine controller and adapted to be positioned by the controller with the fingers of the disc stackers intercepting individual copy sheets 5 as they enter disc input slot 6. The papers 5 then fall away from the stackers 2 and 3 into compiler tray 4 either stapled into sets or not stapled. The copy sheets are collected in the stacking tray or bound or stapled together into sets of copy sheets. The bound or stapled sets of copy sheets are then stacked for presentation to the machine operator.

The output/stacking tray in an embodiment of this invention consist of a fingered telescoping design allowing for the unloading of one stack of finished output while providing another stacking surface for a second stack of output. The outputting of documents need not be interrupted when one of the stacker output trays becomes full since documents can merely be fed to the other stacker output tray. (See FIG. 4) while the full stacker output tray is unloaded. Also included as an option in the present invention are standby Dual Disc Stacker Finishers for use should the "primary" dual Disc Stacker Finisher become filled or break down. There can be a bypass 10 capability in each dual disc stacker finisher which enables it to be bypassed so that documents can be fed to other downstream devices.

In an embodiment earlier discussed, the bypass path 10 could divert marked copies to a copy removal tray 11 or optionally to additional finishing modules or disc stackers (not shown) should either or both disc stackers 2 and 3 become non-operational. Thus, if stacker 3 for example is down, copies originally directed to disc stacker 3 could be diverted to an auxiliary disc stacker via bypass path 10 and still maintain the increased output speed of up to 360 ppm. Sensors could be used to detect when either or both disc stackers 2 and 3 are down and automatically divert marked substrates into bypass 10 to an auxiliary disc stacker 12 or another finishing module or to a tray 11 for removal from the system. Alternatively, this diverting can take place upon the user's request for unloading of the current stacker.

Figure 2:
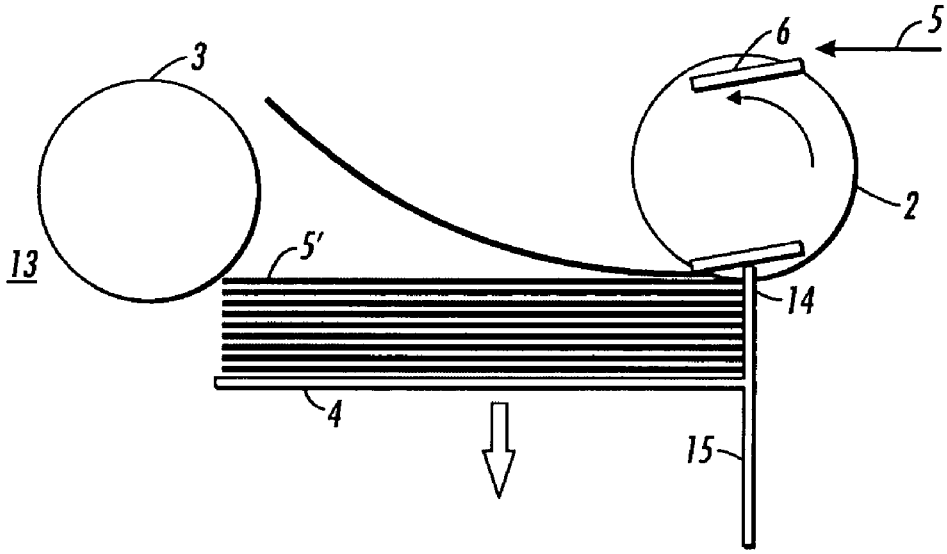
FIG. 2 illustrates the stacking function of an embodiment of the dual disc stacker/stitcher of this invention.
Figure 3:
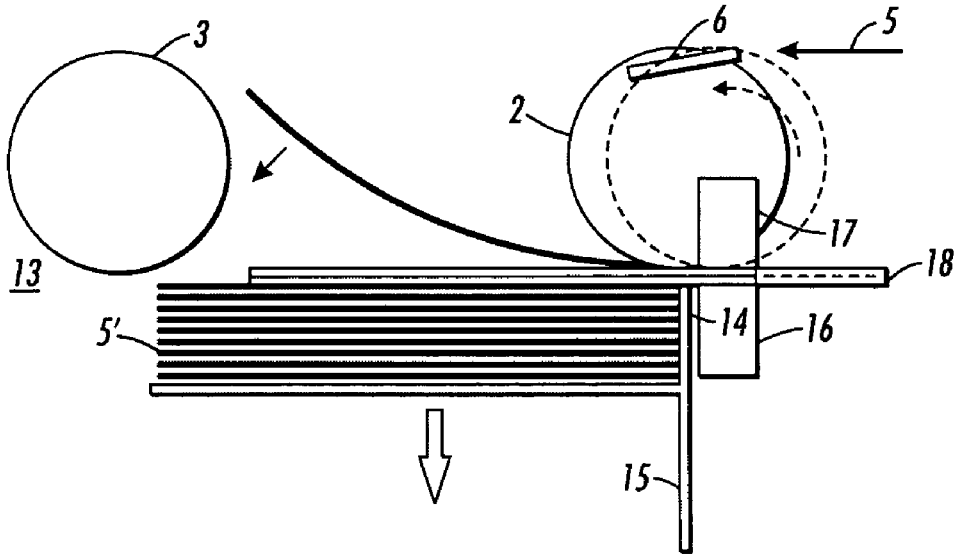
FIG. 3 illustrates the stitching function of an embodiment of the dual disc stacker/stitcher of this invention.

Applicant's system comprises two disc stackers 2 and 3 sharing a common compiling tray 4. FIGS. 2 and 3, however, for clarity will show only one disc stacker 2; the other disc stacker 3 is identical to stacker 2 only positioned at location 13. In order to improve the understanding, in FIGS. 2 and 3 disc stacker 2 function will be described, but it is to be understood that the second disc stacker 3 has the identical function on the opposite side 13 of tray 4.

In FIG. 2 the stacking mode is illustrated where incoming sheet 5 enters disk slot 6 at a load point. The disc 2 drives the sheet 5 towards a retractable wall 14. The disc stacker 2 decels sheet 5 into retractable wall 14 and fixed wall 15. The next sheet 5 repeats this cycle.

In FIG. 3 an embodiment of the stitching mode is illustrated. The stitching mode is the same as the above described stacking mode of FIG. 2 with the following additions. The retractable reg wall 14 gets out of the way. The disc 2 shifts to right in line with stitch heads 16 and amvil 17. The sheet 5 compiles against left edge of-stop/set ejector 18 after clinching, stop/set ejector 18 pushes set 5 back onto stack 5', and this cycle is repeated until the job is completed.

Figure 4:
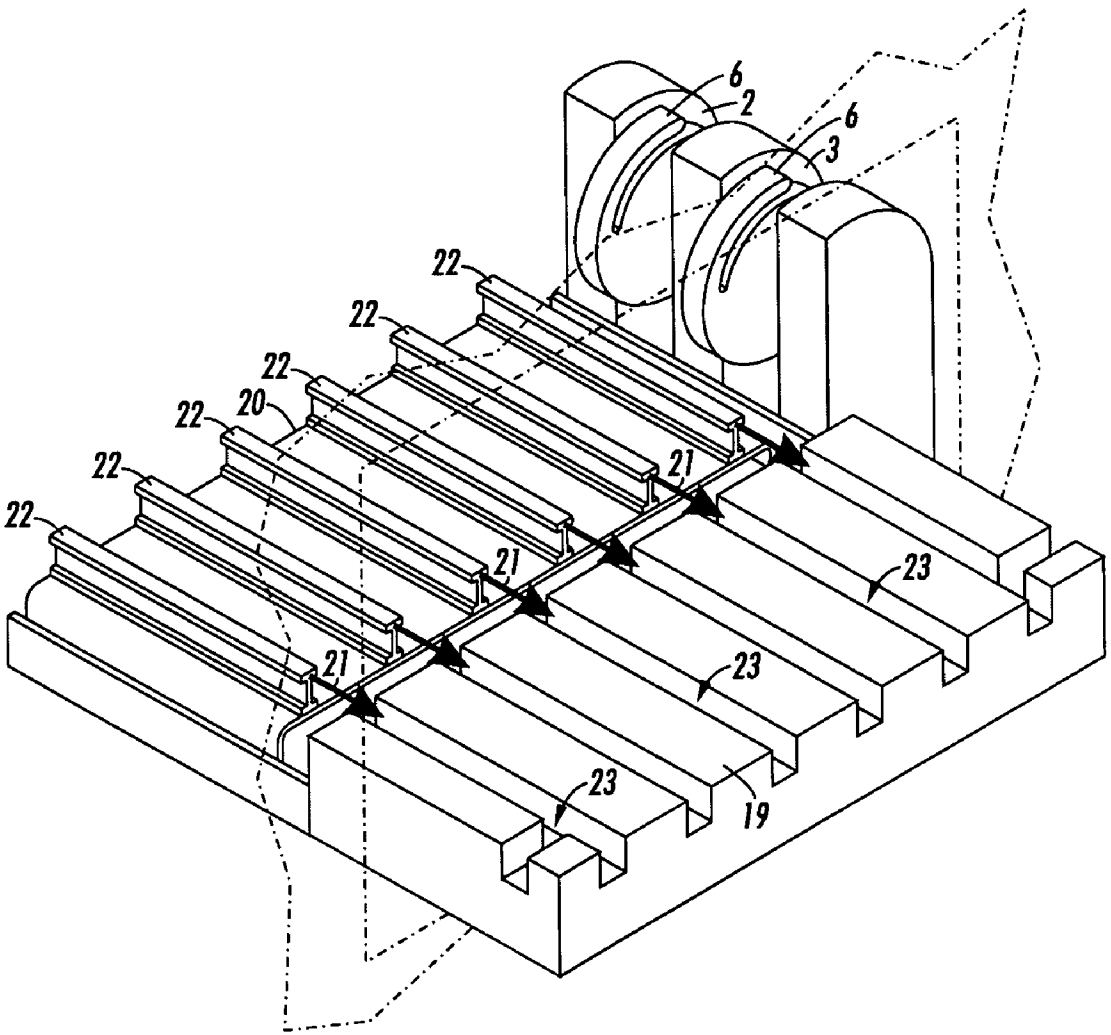
FIG. 4 illustrates an output tray of an embodiment of this invention.

In FIG. 4 an output tray 11 that is useful in the present invention is illustrated. This tray 11 configuration allows unloading to a collector tray 19 one stack of finished output sheets 5 (see FIGS. 2 and 3) while providing primary stacking device 20 for a second stack of output 5. In this manner the outputting of documents 5 need not be interrupted when one of the stacker output trays 19 becomes full since documents can merely be fed to the collector output tray 20. The arrows 21 indicate the direction documents 5 are transferred from primary stacking device 20 to collector tray 19. Projections 22 slidably fit into grooves 23 as the paper is transferred from one tray 20 to the other tray 19. This leaves tray 20 ready to accept a new set of papers 5 from disc stackers 2 and 3 and therefore no interruption because papers 5 have no place to rest after being processed through disc stackers 2 and 3.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A stacker system positioned in a marking device after a paper substrate(s) or print has been marked, said system comprising a first disc stacker and a second disc stacker, and a stacker-compiler tray, said disc stackers being two opposing disc stackers facing each other positioned on opposite sides of said stacker-compiler tray, said two opposing disc stackers configured to have alternating paper output to said stacker compiler tray, said stacker compiler tray configured to receive stacks of said paper, said disc stackers configured to rotate and stack said substrates when said substrates are delivered into a disc input slot of each of said disc stackers, said system configured to handle said substrates for either or both stacking and stitching at production rates of up to 360 prints per minute; and said substrates are driven into said system and are configured to be directed in an alternating one or two-sheet sequence separately to each of said two disc stackers; and wherein said system is configured to provide continuously during a two-sheet alternating sequence where a first two sheets or substrates are directed to said first disc stacker and a third and fourth substrates are directed to said second disc stacker, and in a one-sheet alternating sequence, a first single alternating sheet is sent to said first disc stacker and a second sheet is sent to said second disc stacker, and wherein said stacker compiler tray comprises a collection tray and a collector output tray, said collector tray configured to horizontally transfer said stacked paper or substrates thereon to said collector output tray when said collector tray becomes full, said collector tray comprising projections that are configured to slidably fit into grooves of said collector output tray as said substrate stacked paper is being horizontally transferred from said collector tray to said collector output tray;

said collector tray thereby configured to be ready after said transfer to accept a new stack of papers from said disc stackers without any stacked paper collection interruption in said system.

2. The stacker system of claim 1 wherein for unstitched output, said system is configured to direct one sheet at a time independently and sequentially to each of said two disc stackers.

3. The stacker system of claim 1 wherein said system is configured so that substrates are diverted to said second stacker while said first stacker is rotating.

4. The stacker system of claim 1 comprising in an operational arrangement with said stackers, an inverter to provide face up or face down positions for said paper or substrates.

5. The stacker system of claim 1 wherein a substrate bypass or path and copy output trays are positioned in said system before a location of said disc stackers, said system configured to divert marked copies to said copy output trays for removal of said substrates from said system or to divert said substrates to additional finishing stations or module.

6. The stacker system of claim 1 wherein a stapler is positioned adjacent to each disc stacker, said stapler configured to staple substrates together as sets as they are being stacked by said disc stackers.

7. The stacker system of claim 1 configured to place two said substrates or print into input slots of said disc stackers and stacking two sheets at a time.

8. The stacker system of claim 1 configured to operate said two-disc stackers with alternating output to said stacker compiler tray and having the ability to stack up to 360 ppm without increasing an angular velocity of existing single disc stackers.

* * * * *